US007237601B2

(12) United States Patent
Birk et al.

(10) Patent No.: US 7,237,601 B2
(45) Date of Patent: Jul. 3, 2007

(54) HEAT EXCHANGER FOR COOLING A HOT GAS THAT CONTAINS SOLID PARTICLES

(75) Inventors: Carsten Birk, Berlin (DE); Dieter Bormann, Berlin (DE)

(73) Assignee: Borsig GmbH (DE)

( * ) Notice: Subject to any disclaimer, the term of this patent is extended or adjusted under 35 U.S.C. 154(b) by 66 days.

(21) Appl. No.: 11/254,000

(22) Filed: Oct. 19, 2005

(65) Prior Publication Data

US 2006/0131005 A1 Jun. 22, 2006

(30) Foreign Application Priority Data

Dec. 21, 2004 (EP) ..... 04030220

(51) Int. Cl.
*F28F 19/02* (2006.01)

(52) U.S. Cl. ..... 165/133; 165/134.1; 165/158

(58) Field of Classification Search ..... 165/133, 165/134.1, 158, 178
See application file for complete search history.

(56) References Cited

U.S. PATENT DOCUMENTS 2,143,477 A * 1/1939 Dillon et al. ..... 138/39
2,225,615 A * 12/1940 Bay ..... 285/55
3,540,529 A * 11/1970 Umino et al. ..... 165/134.1
4,706,743 A * 11/1987 Chalimbaud ..... 165/134.1
5,246,063 A 9/1993 Fix et al.
5,647,432 A * 7/1997 Rexford et al. ..... 165/134.1
6,093,454 A 7/2000 Brindley et al.
2001/0040024 A1* 11/2001 Blanda et al. ..... 165/134.1

FOREIGN PATENT DOCUMENTS

JP 6-173034 * 6/1994
JP 06173034 9/1994
WO WO 01/02616 1/2001

* cited by examiner

*Primary Examiner*—Teresa J. Walberg
(74) *Attorney, Agent, or Firm*—Robert W Becker Associates; Robert W Becker

(57) ABSTRACT

A heat exchanger for cooling a hot gas that contains solid particles, comprising heat exchanger tubes through which the hot gas flows, with the tubes being surrounded by a casing, and with ends of the tubes being welded, via weld seams, into bores of respective tube plates disposed at the ends of the casing. A protective layer coats the end face of the gas inlet side tube plate, an inner wall of the bores, the weld seams, and an inlet region of the heat exchanger tubes. The protective layer comprises a metallic adhesive layer, a high temperature and erosion resistant ceramic layer, and a high temperature and erosion resistant metal layer disposed between the adhesive layer and the ceramic layer.

6 Claims, 2 Drawing Sheets

HEAT EXCHANGER FOR COOLING A HOT GAS THAT CONTAINS SOLID PARTICLES

BACKGROUND OF THE INVENTION

The instant application should be granted the priority date of Dec. 21, 2004, the filing date of the corresponding European patent application 04030220.0.

BACKGROUND OF THE INVENTION

The present invention relates to a heat exchanger for cooling a hot gas that contains solid particles.

A heat exchanger of this type is known from EP 0 567 674 B1, and serves for cooling synthetic gas produced in a coal gasification unit. With the known heat exchanger, the tube plate on the gas inlet side is covered with a ceramic layer to protect against erosion and high temperature corrosion. The ceramic layer is comprised of individual ceramic sleeves that are disposed next to one another and that in the upper part have right-angled outer edges that abut one another, and in the lower part have an opening, which extend into the heat exchanger tubes. Below the sleeves, on the tube plate, the weld seam and the tube inlets, is a protective layer comprised of a metallic adhesive layer and a ceramic layer. This protective layer becomes operational if one or more of the sleeves are destroyed.

It is an object of the present invention to simplify a heat exchanger of the aforementioned general type, and to provide more effective erosion protection.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The heat exchanger of the present application comprises heat exchanger tubes through which the hot gas flows, with the heat exchanger tubes being surrounded by a casing, and with ends of the heat exchanger tubes being welded, via weld seams, into bores of respective tube plates that are disposed at the ends of the casing; the heat exchanger also comprises a protective layer that coats the end face of the gas inlet side tube plate, an inner wall of the bores, the weld seams, and an inlet region of the heat exchanger tubes, with the protective layer comprising a metallic adhesive layer, a high temperature and erosion resistant ceramic layer, and a high temperature and erosion resistant metal layer disposed between the adhesive layer and the ceramic layer.

During the course of a coating process, the combination or composite protective layer can be applied to all endangered areas, and offers an optimum protection against erosion not only when the solid particles strike at right angles but also when they strike at an inclination. It has been surprisingly shown that when solid particles strike at an angle of 90 degrees relative to the tube plate, a metallic protective layer is more resistant to erosion than is a ceramic protective layer. However, when the strike angle is 45 degrees relative to the tube plate, in other words with an inclined strike, for example onto the weld seam, a ceramic layer demonstrates a better resistance to erosion than does the metallic layer.

Further specific features of the present application will be described in detail subsequently.

DESCRIPTION OF SPECIFIC EMBODIMENTS

Figure 1:
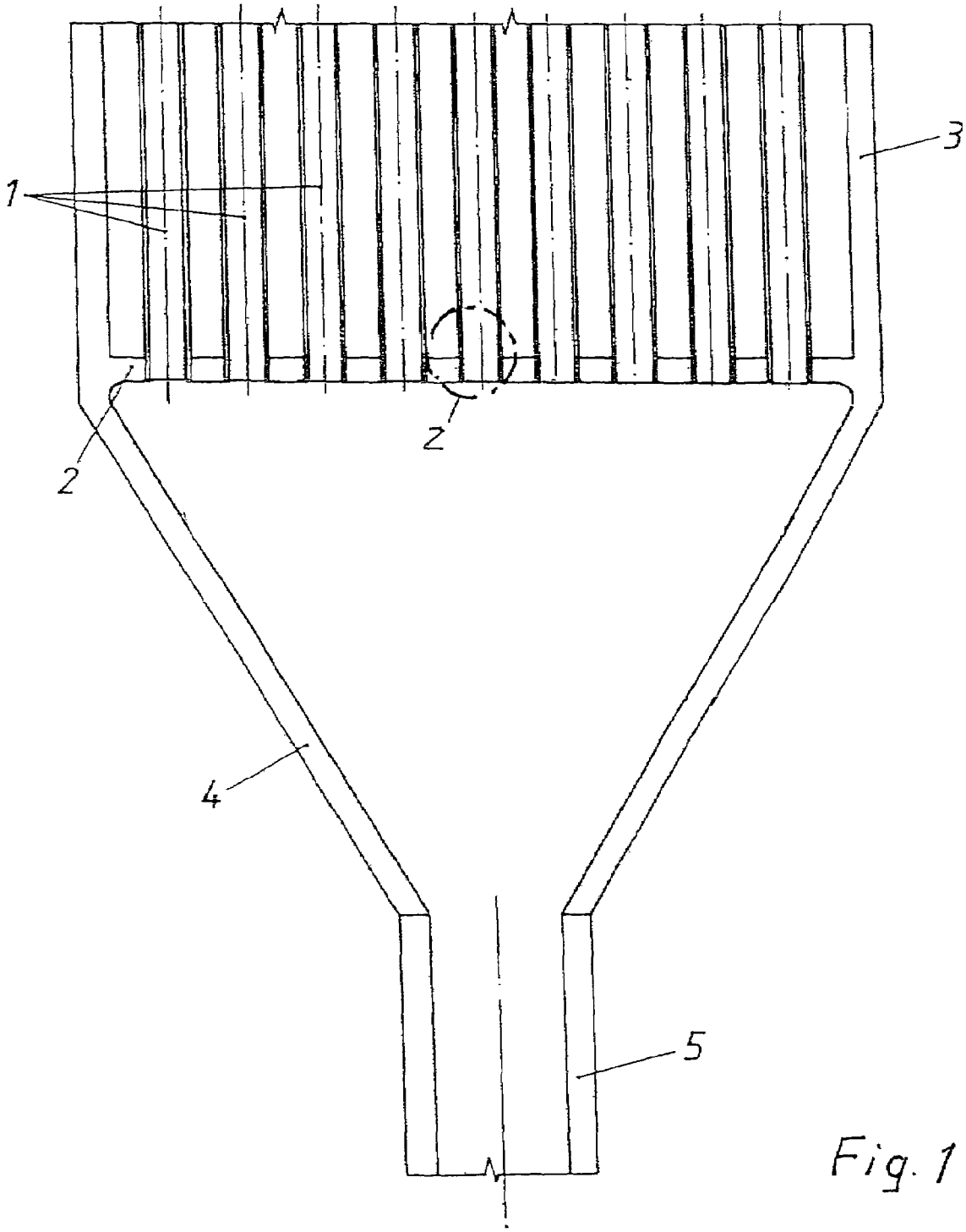
FIG. 1 is a longitudinal cross-sectional view through the lower portion of a heat exchanger.

Referring now to the drawings in detail, only the inlet side portion of a heat exchanger for the cooling of reaction gas is shown in FIG. 1. The heat exchanger comprises a tube bundle of straight heat exchanger tubes 1 that are held in a respective tube plate 2 at each end of the tube bundle. The tube bundle is surrounded by an outer casing 3 that together with the respective tube plates 2 delimits an inner chamber through which flows boiling water that is under high pressure. A respective end chamber 4 adjoins the tube plate 2 on the illustrated gas inlet side and on the non-illustrated gas outlet side; the end chamber 4 is provided with a connector 5 for the supply or withdrawal of the gas. The end chamber 4 widens conically from the connector 5 to the diameter of the tube plate 2. All of the components of the heat exchanger are made of a high-temperature steel.

Figure 2:
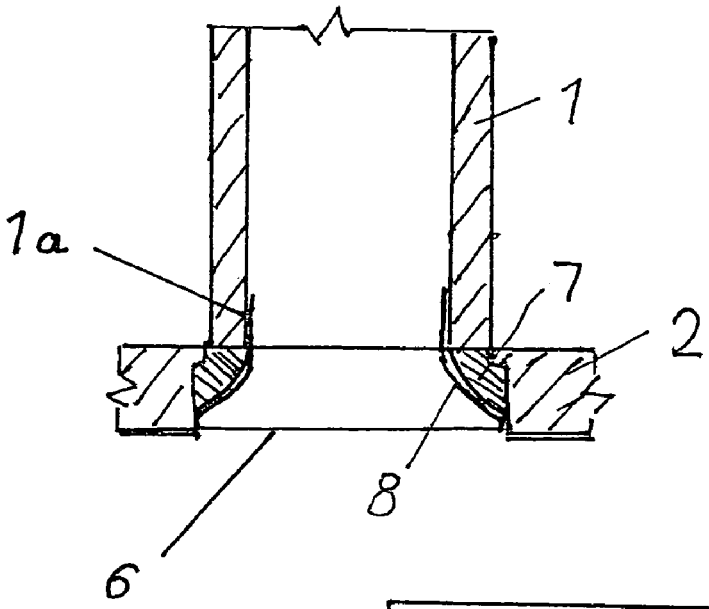
FIG. 2 is an enlarged view of the encircled portion Z in FIG. 1.

Bores 6 pass through the tube plate 2, and the heat exchanger tubes 1 are respectively concentrically inserted into the bores 6 and are welded to the tube plate 2 via a weld seam 7 (see FIG. 2). The weld seam 7 is disposed at the inner edge of the heat exchanger tube 1 and is embodied as a concavely curved fillet weld. The hot gas that is introduced through the end chamber 4 encounters the tube plate 2 and flows through the bores 6 of the tube plate, along the weld seam and into the heat exchanger tubes 1. The solid particles carried along by the gas strike the end face of the tube plate 2 at right angles and strike the weld seam 7 at an angle, thus leading to erosion at those locations. Erosion also occurs in the inlet region of the heat exchanger tubes 1 due to turbulence. To protect against erosion, the end face of the tube plate 2, the weld seam 7 at the inner edge of each heat exchanger tube 1, and the inlet region 1*a* of the heat exchanger tubes 1 are covered with a triple-layer protective layer 8.

Figure 3:
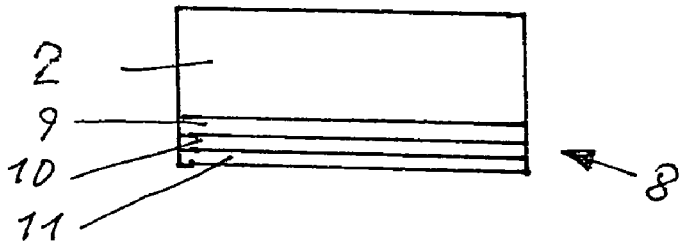
FIG. 3 shows a protective layer.
Figure 4:
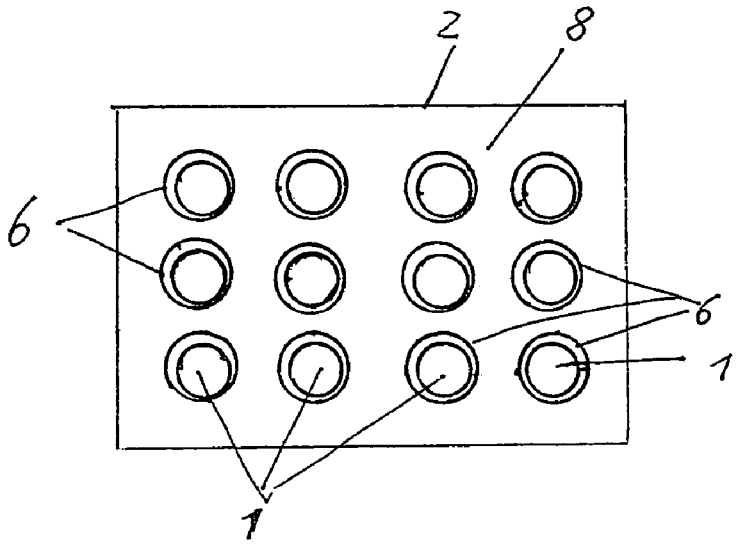
FIG. 4 is a plan view onto the tube plate of the heat exchanger of FIG. 1.

As shown in FIG. 3, the protective layer 8 comprises an adhesive layer 9 that is applied to the surface of the tube plate 2, to the weld seam 7 at the inner edge of the heat exchanger tube 1, and to the inner side of each heat exchanger tube 1 in the inlet region 1*a*. The adhesive layer 9 serves as an adhesive agent for the following layers, which form the actual erosion protection. Applied to the adhesive layer 9 is a high temperature resistant and erosion resistant metal layer 10, and a high temperature resistant and erosion resistant ceramic layer 11 is applied to the metal layer 10.

The individual layers are applied by flame spraying. The metal layer 10 and the adhesive layer 9 each comprise a nickel-based alloy that is alloyed with one or more of the elements aluminum, cerium, iron, molybdenum and silicon. The ceramic layer 11 is comprised of zirconium oxide stabilized with calcium.

The overall protective layer 8 has a thickness of 0.5 to 1.5 mm, preferably approximately 1 mm. By way of example, the adhesive layer 9 has a thickness of about 0.1 to 0.5 mm, preferably 0.2 mm, the metal layer 10 has a thickness of approximately 0.2 to 0.8 mm, preferably 0.4 mm, and the ceramic layer has a thickness of approximately 0.1 to 0.6 mm, preferably 0.3 mm.

The specification incorporates by reference the disclosure of European priority document 04030220.0 filed 21 Dec. 2004.

The present invention is, of course, in no way restricted to the specific disclosure of the specification and drawings, but also encompasses any modifications within the scope of the appended claims.

What I claimed is:

1. A heat exchanger for cooling a hot gas that contains solid particles, comprising:

a casing;

respective tube plates disposed at ends of the casing;

heat exchanger tubes through which said hot gas flows, wherein said heat exchanger tubes are surrounded by said casing, and wherein ends of said heat exchanger tubes are welded into bores of said tube plates via weld seams; and a protective layer that coats: an end face of that one of said tube plates disposed on a gas inlet side, an inner wall of said bores, said weld seams, and an inlet region of said heat exchanger tubes, and wherein said protective layer comprises a metallic adhesive layer, a high temperature and erosion resistant ceramic layer, and a high temperature and erosion resistant metal layer disposed between said adhesive layer and said ceramic layer.

2. A heat exchanger according to claim 1, wherein each of said metal layer and said adhesive layer is comprised of a nickel-based alloy that is alloyed with at least one of aluminum, cerium, iron, molybdenum and silicon.

3. A heat exchanger according to claim 1, wherein said ceramic layer is comprised of zirconium oxide stabilized with calcium.

4. A heat exchanger according to claim 1, wherein said protective layer has an overall thickness of from 0.5 to 1.5 mm.

5. A heat exchanger according to claim 4, wherein said adhesive layer has a thickness of from 0.1 to 0.5 mm, said metal layer has a thickness of from 0.2 to 0.8 mm, and said ceramic layer has a thickness of from 0.1 to 0.6 mm.

6. A heat exchanger according to claim 5, wherein said adhesive layer has a thickness of about 0.2 mm, said metal layer has a thickness of about 0.4 mm, and said ceramic layer has a thickness of about 0.3 mm.

* * * * *